United States Patent [19]

Nagasaka et al.

[11] Patent Number: 4,952,166

[45] Date of Patent: Aug. 28, 1990

[54] SCREW-FASTENING TYPE MULTI-CONNECTOR

[75] Inventors: Yasuhiro Nagasaka, Toyota; Yuji Hatagishi, Shizuoka; Naoki Manabe, Kosai, all of Japan

[73] Assignee: Yazaki Corporation, Tokyo, Japan

[21] Appl. No.: 367,593

[22] Filed: Jun. 19, 1989

[30] Foreign Application Priority Data

Jun. 21, 1988 [JP] Japan ..... 63-81124[U]

[51] Int. Cl.[5] ..... H01R 13/621

[52] U.S. Cl. ..... 439/364

[58] Field of Search ..... 439/359, 362, 364, 677, 439/924, 678, 680

[56] References Cited

U.S. PATENT DOCUMENTS 3,731,258 5/1973 Spicer ..... 439/364 X 4,179,179 12/1979 Lowden ..... 439/364 X

*Primary Examiner*—Eugene F. Desmond

*Assistant Examiner*—Walter G. Hanchuk

*Attorney, Agent, or Firm*—Armstrong, Nikaido, Marmelstein, Kubovcik & Murray

[57] ABSTRACT

The multi-terminal connectors consists of male terminals provided in one of mating connector housings and corresponding female terminals in the other connector housing. The two mating connector housings are joined together by a bolt and a nut for secure connection between terminals, the bolt being provided to one of the connector housings, the nut being provided to the other connector housing. The terminals in the connector housings are so arranged in rows that the quantity of terminals person progressively decreases in proportion to the distance from the center axis of the housings toward the periphery, to reduce over the entire length of the connector housings, the net bending moment applied on the connector housings when the mating terminals are engaged. This prevents the connector housings from being warped and therefore terminals near the periphery from being connected inclined, assuring smooth and secure connection of terminals.

2 Claims, 3 Drawing Sheets

SCREW-FASTENING TYPE MULTI-CONNECTOR

BACKGROUND OF THE INVENTION

1. Field of the Invention

The present invention relates to a screw-fastening type multi-terminal connector for making electrical connections comprising connector housings respectively having a plurality of female and male connectors therein, which prevents warping of the connector housing when the connector is tightened by screw, thereby improving the reliability of terminal connection.

2. Description of the Prior Art

Conventional screw-fastening type connectors have the following construction. As shown in FIG. 2, one of the mating synthetic resin connector housings 1' is formed with a plurality of longitudinally and laterally arranged terminal cavities 10. A nut 6' is rigidly installed in the interior of the connector housing 1' at the center. The other connector housing 2' has a bolt 3' rotatably mounted in the central portion thereof. The bolt 3' is screwed into the nut 6' for secure connection between the male terminals 12 in the connector housing 2' and the corresponding female terminals 11 in the connector housing 1'. Tightening of the bolt also prevents undesired disconnection between the mating connectors.

In such a conventional connector construction, the terminal insertion force applied between the male and female terminals 12, 11 during jointing is constant over the entire longitudinal length of the connector housings. Hence, the bending moment progressively increases from the center of the junction 13 toward the longitudinal ends in the direction of arrows E in FIG. 3. Therefore, the connector housing 1' is warped in a direction opposite to the terminal insertion direction, with the result that the male and female terminals 12, 11 near the longitudinal ends inclinedly engage with each other. This inclined engagement may result in unsmooth terminal insertion and faulty electrical connection.

SUMMARY OF THE INVENTION

It is therefore an object of the present invention to provide a screw-fastening type connector which overcomes the above drawback and enables secure terminal connection without producing warping in the connector housings when the mating connector housings are joined together.

To achieve the above objective, a screw-fastening type multi-connector according to the invention comprises a pair of housings; a female connector housing having a plurality of male terminals and a male connector housing having a plurality of female terminals, a bolt rotatably mounted at the center of the male connector housing, the bolt having a threaded shank portion protruding in the axial direction thereof, a female screw member provided in the center of the female connector housing, the female screw member being adapted for receiving the threaded shank portion of the bolt so as to secure interconnection between the female and male terminals; the terminals being arranged in rows surrounding the center axis of the connector housings in such a way that the quantity thereof progressively reduces in proportion to the distance from the center of the housings towards outer peripheries thereof, whereby the net bending moment applied over the connector housings in a entire direction intersecting said axial direction at right angles is reduced upon engagement of these terminals.

Since the quantity of terminals 9 per row installed in the connector housing 2 progressively decreases toward the outer periphery 8, when the mating terminals are connected, an insertion reactive force applied to the connector housing 2 progressively reduces in proportion to the distance from the center of joint of the connector housing to the outer periphery. Thus, the net bending moment exerted on the connector housing 2 is reduced over the entire length from the center to the outer periphery 8. This in turn prevents the connector housing from being warped and therefore the terminals near the outer periphery 8 are also prevented from being inclinedly connected, assuring smooth and secure connection of terminals.

DETAILED DESCRIPTION OF A PREFERRED EMBODIMENT

Figure 1:
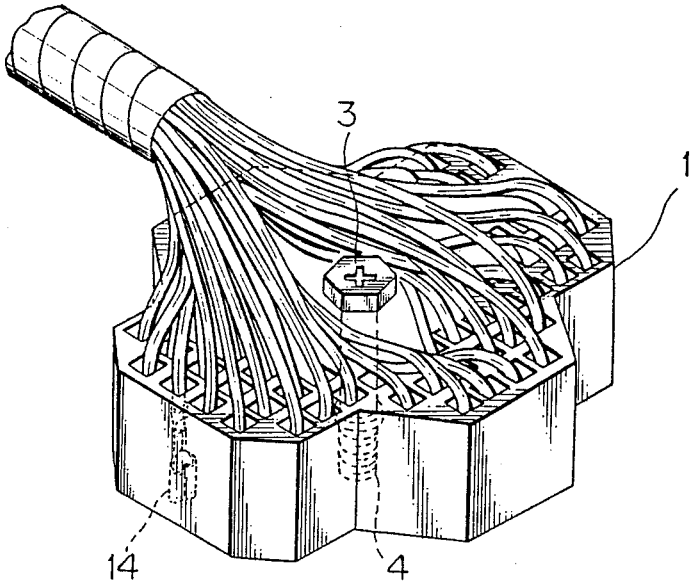
FIG. 1 is a perspective view of a screw-fastening type connector as one embodiment of the present invention.
Figure 1:
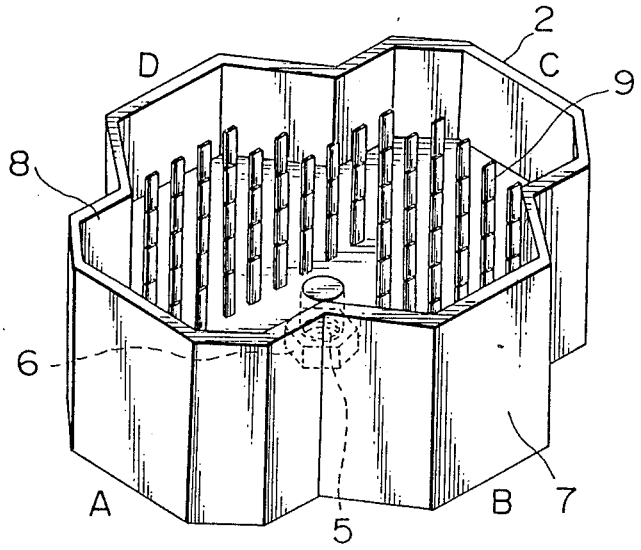
Figure 2:
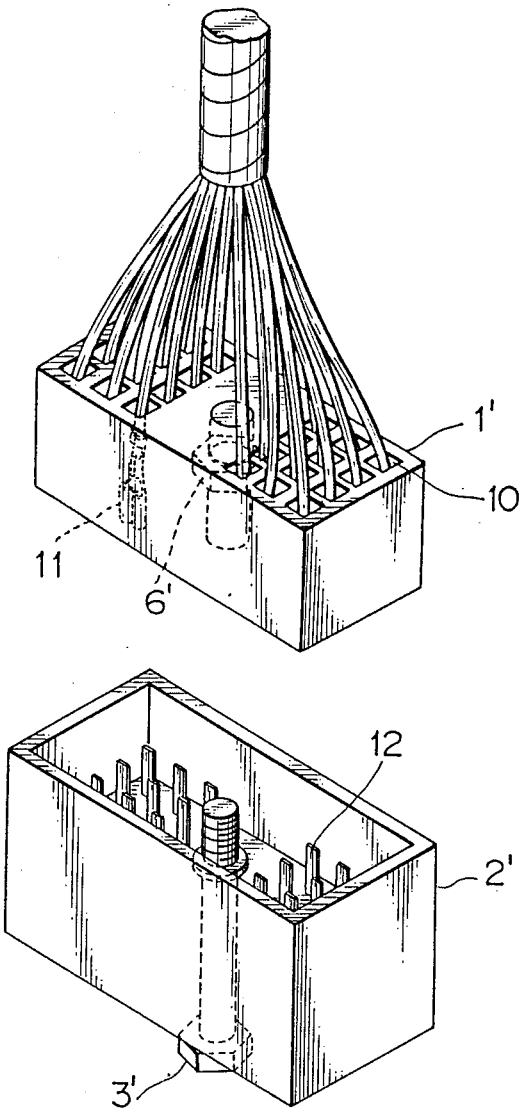
FIG. 2 is a perspective view of a conventional screw-fastening type connector.
Figure 3:
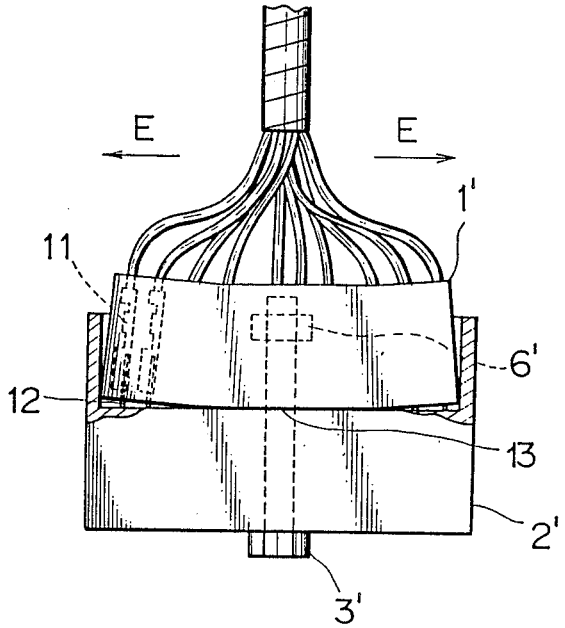
FIG. 3 is an elevational schematic view showing the connectors joined together in the conventional screw-fastening type connector.

FIG. 1 is a perspective view of a screw-fastening type connector as one embodiment of the invention. In the connector housing 2, male push-on terminals 9 are erected and arranged in rows in four orthogonal directions A to D in such a manner that the quantity of terminals progressively reduces stepwise from the center of the connector housing 2 to the outer periphery. The outer wall 7 enclosing the male push-on terminals 9 is shaped like a deformed rhomb.

A nut is fixedly embedded in the center of the connector housing 2. A bolt 3 is rotatably mounted through the center of the outer connector housing 1 and the threaded shank 4 of the bolt 3 is screwed into the tapped part 5 of the nut 6. By fastening the bolt 3 to the nut 6 the male push-on terminals 9 are inserted into the female push-on terminals 14 provided to the connector housing 1.

In the screw-fastening type connector according to the invention, since the quantity of terminals 9 per row reduces toward the outer periphery 8 where the connector housing would otherwise be easily deflected by the bending moment caused centering around the coupling center 5 of the connector housings during terminal connection, the bending moment exerted on the outer periphery 8 of the connector housing 2 does not become greater than on the central portion as it is with the conventional connectors. Therefore, the connector housing 2 will not be warped, assuring smooth and reliable terminal connection.

As described above, with the present invention the multi-terminal mating connector housings can be securely joined together at one time, making unnecessary the redoing of connector jointing work that is often carried out with the conventional connectors until a perfect connection is obtained. This in turn improves work efficiency and at the same time prevents deformation of terminals, drastically reducing the occurrence of component failures and improving reliability of terminal connection. Another advantage of this invention is that since it is not necessary to increase rigidity of the connector housing, the material thickness of the connector housing can be reduced, lowering the material cost.

What is claimed is:

1. A screw-fastening type multi-connector comprising:

a first connector housing having a center axis and a plurality of male terminals longitudinally parallel to said center axis, said plurality of male terminals being arranged in rows perpendicular to and surrounding said center axis such that said rows are located at progressively increasing distances from said center axis and the number of said male terminals per row decreases as the distance of the said row from said center axis increases;

a second connector housing having a center axis and a plurality of female terminals longitudinally parallel to said center axis, said plurality of female terminals being arranged identically to said plurality of said male terminals of said first connector;

a bolt rotatably mounted on said center axis of said second connector housing, said bolt having a threaded shank portion protruding along said center axis; and a female screw member provided on said center axis of said first connector housing, said female screw member being adapted for receiving said threaded shank portion of said bolt;

said first and second connector housings being connectable and held together via said bolt and said female screw member such that the insertion reactive force exerted on a particular portion of the connector housings by the arrangement of said male and female terminals during connection of said first and second connector housings is progressively smaller in proportion to the distance of that portion from said center axis of said housing.

2. A screw-fastening type multi-connector comprising:

a first connector housing having a bolt rotatably mounted along a longitudinal centerline of said first connector housing and a plurality of female terminals lying longitudinally parallel to said centerline bolt, said female terminals being arranged in rows perpendicular to and surrounding said centerline bolt such that said rows are located at progressively increasing distances from said centerline bolt and the number of female terminals per row decreases as the distance of the said row from said centerline bolt increases, said centerline bolt having a threaded shank portion along a protruding end of said centerline bolt; and a second connector housing having a female screw member mounted along a longitudinal centerline of said second connector housing and a plurality of male terminals being arranged identically to said plurality of said female terminals of said first connector housing, said centerline screw member being adapted for receiving said threaded shank portion of said centerline bolt and said male terminals adapted to connect with said female terminals, said first and second connector housings being connectable and held together via said centerline bolt and centerline screw member.

* * * * *